US006098443A

United States Patent [19]

Müller et al.

[11] Patent Number: 6,098,443

[45] Date of Patent: Aug. 8, 2000

[54] DEVICE FOR PRODUCING AN INSULATION CRIMP ON AN ELECTRICAL CONNECTOR

[75] Inventors: Horst Müller, Pfungstadt; Günter Sowa, Nieder-Olm, both of Germany

[73] Assignee: The Whitaker Corporation, Wilmington, Del.

[21] Appl. No.: 09/136,944

[22] Filed: Aug. 20, 1998

[30] Foreign Application Priority Data

Aug. 29, 1997 [DE] Germany ..... 197 37 863

[51] Int. Cl.[7] ..... H01R 43/048

[52] U.S. Cl. ..... 72/412; 72/409.14; 29/753

[58] Field of Search ..... 72/412, 409.14, 72/409.06; 29/751, 753, 863, 861

[56] References Cited

U.S. PATENT DOCUMENTS

| | | | |
|---|---|---|---|
| 2,077,335 | 4/1937 | Lemming | 72/330 |
| 2,452,932 | 11/1948 | Johnson . | |
| 2,557,126 | 6/1951 | Macy | 173/269 |
| 2,943,293 | 6/1960 | Bucher et al. | 339/223 |
| 3,010,183 | 11/1961 | Forney . | |
| 3,404,368 | 10/1968 | Roberts et al. | 339/223 |
| 3,747,190 | 7/1973 | Erlichman . | |
| 5,390,410 | 2/1995 | Takenami | 72/412 |
| 5,561,267 | 10/1996 | Fudoo et al. | 174/84 C |

FOREIGN PATENT DOCUMENTS

| | | | |
|---|---|---|---|
| 592253 | 4/1994 | European Pat. Off. | 29/753 |
| 25 55 709 C2 | 5/1986 | Germany | H01R 4/18 |
| 42 15 163 C2 | 1/1995 | Germany | H01R 43/04 |
| 19523557 A1 | 1/1997 | Germany | H01R 13/03 |
| 3-291881 | 12/1991 | Japan | 29/861 |
| 98184 | 6/1961 | Norway | 29/753 |

OTHER PUBLICATIONS

Copy of German Search Report.

*Primary Examiner*—Daniel C. Crane

[57] ABSTRACT

The invention relates to electrical connectors having a crimp region with a wire crimp for making contact with an electric conductor, and with an insulation crimp for fastening a single-wire seal to the insulated conductor, the insulation crimp and the wire crimp each including a curved base with crimp arms that adjoin both sides on the outside and essentially form a U, the free ends of the crimp arms of the insulation crimp having an inwardly directed curved region with a radius of curvature which corresponds to the radius of the closed insulation crimp.

1 Claim, 2 Drawing Sheets

DEVICE FOR PRODUCING AN INSULATION CRIMP ON AN ELECTRICAL CONNECTOR

BACKGROUND OF THE INVENTION

1. Field of the Invention

The invention relates to an electrical connector having a crimp region having a wire crimp for making contact with an electric conductor, and with an insulation crimp for fastening a single-wire seal to the insulated line. In addition, the invention relates to a method of producing an insulation crimp using an electrical connector having an insulation crimp as described above and to a device for carrying out the method.

2. Description of the Prior Art

A crimp monitoring method for detecting crimping faults is disclosed by DE 42 15 163 A1. In this case, an electrical contact element made of a stamped sheet-metal part is crimped onto an electric conductor wire in crimping tools. The electrical contact element has a contact region and a crimp region with a wire crimp and an insulation crimp. The two crimps comprise a curved base and crimp arms that adjoin both sides on the outside and essentially form a U.

When the wire crimp and the insulation crimp are being closed, the wire crimp wraps around the wire end region, which is free of the insulation sheath, and the insulation crimp wraps around the insulation sheath of the conductor wire. As can be seen from FIG. 1 of DE 42 15 163 A1, with the ready-produced crimp, the free ends of the insulation crimp penetrate into the insulation. This is often desirable, in order to effect a good mechanical connection to the insulation sheath of the conductor wire. The crimp monitoring method is geared particularly to monitoring the wire crimp. Up until now, the design of the crimp arms has been geared essentially to the conductor crimp, which produces the appropriate contact with the conductor wire.

Such conductor crimps are known, for example, from DE 25 55 709 C2, from U.S. Pat. No. 3,404,368 and from U.S. Pat. No. 2,557,126. All these designs are used to make contact with the conductor.

For watertight applications of electrical plug connectors, it is usual to provide so-called single-wire seals, which are fastened to the insulated conductor using the insulation crimp. To this end, the single-wire seals have a cylindrical region which is enclosed by the insulation crimp. If the free ends of the insulation crimp arms then penetrate partly into the single-wire seal, then the latter is damaged and an adequate sealing effect is no longer ensured under all circumstances. In order to achieve a good sealing effect it is important that a crimp of round cross-section can be produced.

SUMMARY OF THE INVENTION

The object of the invention is to specify an electrical connector having a crimp region, a method of producing an insulation crimp and a device for carrying out the method, with which device a wire seal can be fastened on an insulated conductor without the single-wire seal being damaged. The object is achieved by an electrical connector with a crimp region having a wire crimp for making contact with an electric conductor, and having an insulation crimp for fastening a single-wire seal to the insulated conductor, the closed insulation crimp having a radius, the insulation crimp and the wire crimp each including a curved base and crimp arms with free ends that adjoin both sides of the base on the outside and basically form a U, wherein the free ends of the crimp arms of the insulation crimp have an inwardly directed curved region with a radius of curvature which corresponds to the radius of the closed insulation crimp. The object is also achieved by a method for producing the insulation crimp comprising the steps of introducing the insulation crimp into a crimping press, introducing an insulated conductor with a single-wire seal into the crimping press over the insulation crimp, closing the crimping press, guiding the insulation crimp at the sides and lowering the conductor with the single-wire seal into the insulation crimp, and closing the insulation crimp after the single-wire seal has been lowered into the insulation crimp as far as possible without deformation. The object is further achieved by a device for carrying out the method with an insulation crimper having a lower plunger with a curved holder to accommodate the curved base of the insulation crimp, and having an insulation crimp plunger which has a profile which initially has a locating funnel, whose minimum dimension corresponds to the greatest width of the open insulation crimp, and which then has a guide region of constant width and a rounded region, adjoining the said guide region, for producing an insulation crimp of essentially round cross-section.

In order to fasten a single-wire seal to an insulated conductor by means of an insulation crimp, it is necessary for this insulation crimp to be essentially round in cross-section. If an insulation crimp is carried out using an insulation crimp with straight crimp arms, then the crimp is angular in the region of the ends of the crimp arms, rather than being round in cross-section, since the ends of the crimp arms do not maintain the roundness during the production of the crimp, on account of their elastic behaviour. In order to circumvent this problem, it is possible to use crimp arms which have pre-shaped ends. The pre-shaped ends are to be configured in such a way that they correspond to the radius of the closed insulation crimp, that is to say of the insulation crimp. In particular bevelling the free ends of the crimp arms on the inside achieves the situation where there is no sharp edge that could cut into the single-wire seal. A round shape is achieved by means of this procedure.

However, if the pre-shaped insulation crimp is inserted into a conventional insulation crimper, then it will be found that damage is caused by the pre-shaped insulation crimp during the insertion of the single-wire seal. In order to avoid this, an insulation crimp plunger having a modified profile is specified here, this plunger initially having a locating funnel, whose minimum dimension corresponds to the greatest width of the open insulation crimp, having a guide region of constant width, adjoining the said locating funnel, and then having a rounded region whose roundness corresponds to the radius of the closed insulation crimp. It is possible for a funnel-like region to be connected between the guide region and the rounded region. The transition from the guide region into the funnel-like region likewise takes place via a rounded section that corresponds to the radius of the closed insulation crimp.

DETAILED DESCRIPTION OF THE PREFERRED EMBODIMENT

Figure 1:
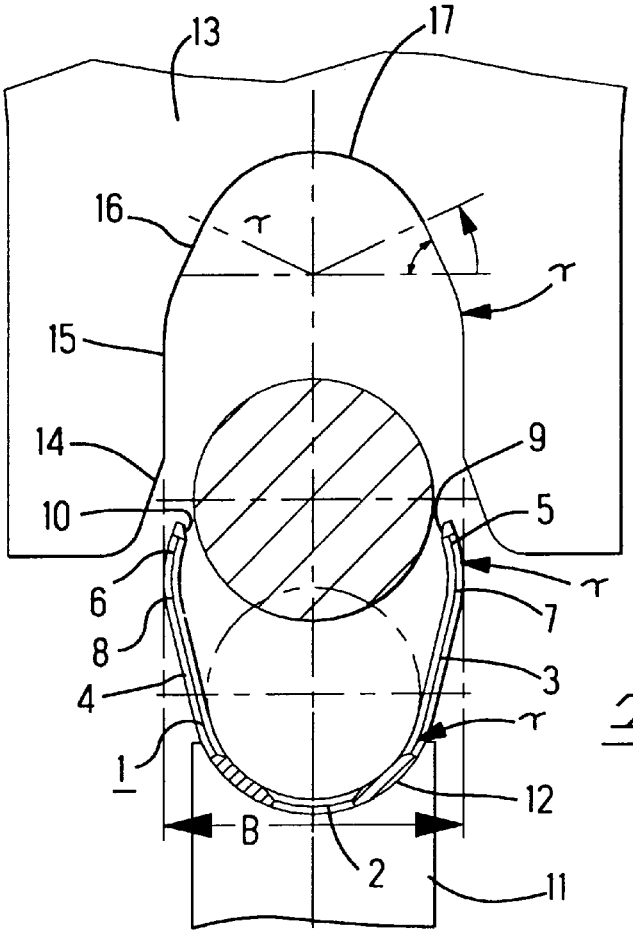
FIG. 1 shows a schematic illustration of an insulation crimper, with an insulation crimp inserted and a single-wire seal indicated.

The insulation crimp 1 can be seen in FIG. 1. The crimp has a curved base 2, from which two crimp arms 3, 4 adjoin both sides on the outside and opposite each other. The crimp arms 3, 4 and the base 2 essentially form a U. The curvature of the curved base 2 is designed in such a way that it corresponds to the curvature of the closed insulation crimp. The free ends 5, 6 of the crimp arms 3, 4 each have an inwardly curved region 7, 8 with a radius of curvature r. This radius of curvature r corresponds to the radius of curvature of the curved base and thus also to the radius of the closed insulation crimp. Furthermore, it can be seen that the free ends 5, 6 have a bevel 9, 10 on the inside. This bevel is intended to ensure that no sharp edges cut into the single-wire seal.

In FIG. 1, the insulation crimp 1 is inserted into a curved holder 12 in the lower plunger 11. The curved holder accommodates the curved base 2 of the insulation crimp 1. FIG. 1 also shows the insulation crimping plunger 13, the upper plunger with the corresponding crimping profile. The crimping profile initially has a locating funnel region 14. If the upper and lower plungers 11, 13 are joined together, the insulation crimp 1 is initially brought into the correct position by this locating funnel, if the position is not already aligned. Located between the crimping profile of the upper plunger 13 and the lower plunger 11 with the insulation crimp 1 is the wire with the single-wire seal, which is illustrated here by a hatched circle. It is also possible to see from the figure that a guide region 15 adjoins the locating funnel 14. As can be seen easily from this drawing, the width B of the guide region corresponds to the greatest width of the insulation crimp. This guide region 15 is, in turn, adjoined by a curved region with the radius of curvature r, and this is adjoined by a funnel-like region 16 for narrowing the clear width of the profile, and said region 16 is adjoined by a rounded region 17 whose radius of curvature r corresponds to the radius of curvature of the finished insulation crimp.

Figure 2:
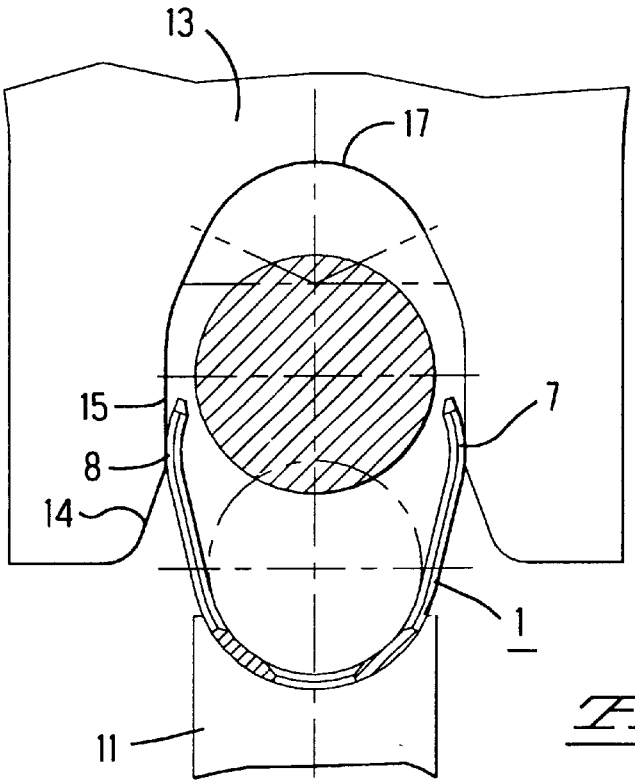
FIG. 2 shows the same arrangement in a second position of the plungers in relation to each other.

In FIG. 2, the same parts are illustrated at a later point in time, that is to say when the upper plunger and lower plunger have been moved closer to each other. The insulation crimp 1 is located with its curved regions 7, 8 in the guide region 18. In this guide region, the insulation crimp 1 is then led past the wire with the single-wire seal, without cutting into the latter. Ideally, in this state, the single-wire seal does not move in relation to the upper plunger 13.

Figure 3:
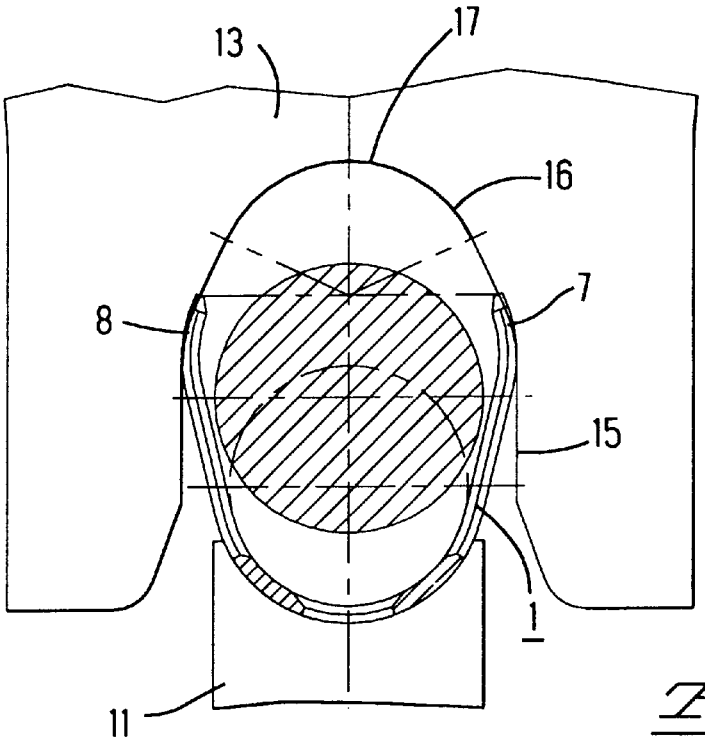
FIG. 3 shows the arrangement in a third position of the plungers in relation to each other.
Figure 4:
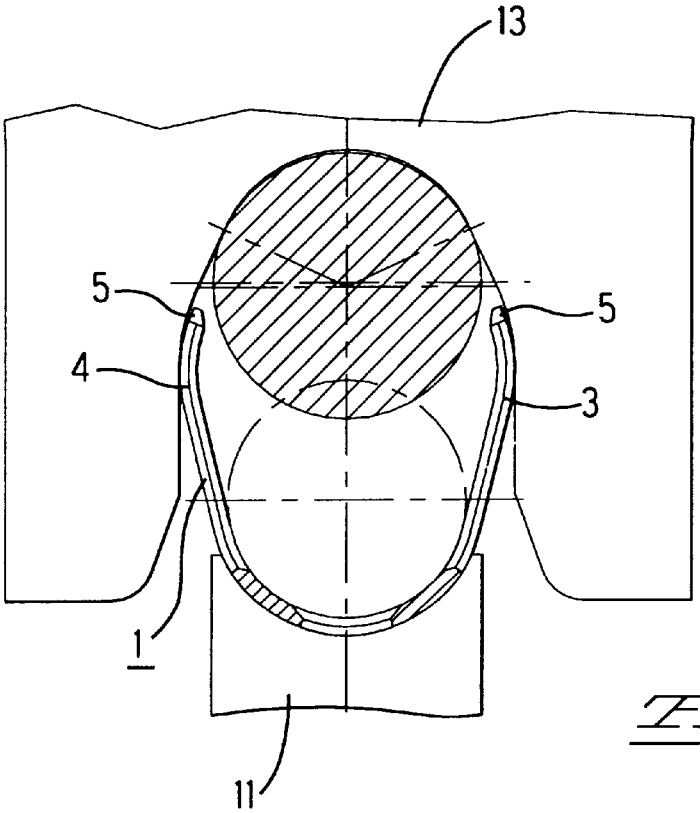
FIG. 4 shows an arrangement with the single-wire seal inserted wrongly.

FIG. 3, then, illustrates a further stage in the crimping sequence, the curved regions 7, 8 of the insulation crimp 1 now being located in the region between the guide region 15 and the funnel-like region 16. The single-wire seal now virtually touches the walls of the insulation crimp 1. When the lower plunger 11 and upper plunger 13 are brought further together, the insulation crimp 1 closes and adapts to the curvature of the rounded region 17. This produces round crimping of the insulation crimp 1 around the single-wire seal, cutting into the single-wire seal being avoided. When the insulation crimp has been closed, the single-wire seal is slightly compressed. FIG. 4, then, indicates that, even if the single-wire seal is located in the upper region of the profile, the free ends 5, 6 of the crimp arms 3, 4 of the insulation crimp 1 are led past the single-wire seal without damaging it. This is brought about by the specific shaping of the profile and the specifically pre-shaped insulation crimp 1.

We claim:

1. A device for carrying out a method for producing an insulation crimp comprising: an insulation crimper having a lower plunger with a curved holder to accommodate the curved base of the insulation crimp, and an insulation crimp plunger which has a profile which initially has a locating funnel whose minimum dimension corresponds to the greatest width of the open insulation crimp, followed by a guide region of constant width and then a rounded region having two stages with different radii of curvature adjoining the guide region via a funnel-like region, for producing an insulation crimp of essentially round cross-section.

* * * * *